US011342144B2

(12) United States Patent
Hofsaess

(10) Patent No.: US 11,342,144 B2
(45) Date of Patent: May 24, 2022

(54) TEMPERATURE-DEPENDENT SWITCH

(71) Applicant: Marcel P. Hofsaess, Steintahleben (DE)

(72) Inventor: Marcel P. Hofsaess, Steintahleben (DE)

( * ) Notice: Subject to any disclaimer, the term of this patent is extended or adjusted under 35 U.S.C. 154(b) by 0 days.

(21) Appl. No.: 16/953,429

(22) Filed: Nov. 20, 2020

(65) Prior Publication Data

US 2021/0166900 A1 Jun. 3, 2021

(30) Foreign Application Priority Data

Nov. 29, 2019 (DE) ..... 10 2019 132 433.5

(51) Int. Cl.
*H01H 37/54* (2006.01)
*H01H 37/04* (2006.01)
*H01H 37/64* (2006.01)

(52) U.S. Cl.
CPC ..... *H01H 37/5427* (2013.01); *H01H 37/04* (2013.01); *H01H 37/64* (2013.01); *H01H 2037/5481* (2013.01); *H01H 2223/002* (2013.01)

(58) Field of Classification Search
CPC .... H01H 37/5427; H01H 37/04; H01H 37/64; H01H 2037/5481; H01H 2223/002; H01H 9/04
See application file for complete search history.

(56) References Cited

U.S. PATENT DOCUMENTS 5,877,671 A * 3/1999 Hofsass ..... H01H 37/5427 337/343
6,207,271 B1 * 3/2001 Daroux ..... B32B 5/024 428/344
6,823,580 B2 11/2004 Hofsaess
(Continued)

FOREIGN PATENT DOCUMENTS

DE 4139091 A1 8/1993
DE 19623570 A1 1/1998
(Continued)

OTHER PUBLICATIONS

Takeda Hideaki, "Safety Device", Oct. 31, 2002, Entire Document (Translation of WO 02086927) (of record, cited in IDS, including Original Copy). (Year: 2002).*
(Continued)

*Primary Examiner* — Stephen S Sul
(74) *Attorney, Agent, or Firm* — Reising Ethington, P.C.

(57) ABSTRACT

A temperature-dependent switch comprising a housing, which comprises a cover part and a lower part, wherein an insulating foil is arranged between the cover part and the lower part. The temperature-dependent switch further comprises a first external contact surface provided externally on the housing, a second external contact surface provided externally on the housing, and a temperature-dependent switching mechanism arranged in the housing. The temperature-dependent switching mechanism, depending on its temperature, establishes or opens an electrically conductive connection between the first and the second external contact surfaces. The insulating foil is at least partially coated or printed with a sealing agent which, for sealing the housing, contacts the cover part and/or the lower part in a sealing area.

18 Claims, 7 Drawing Sheets

(56) References Cited

U.S. PATENT DOCUMENTS

| | | | | |
|---|---|---|---|---|
| 8,536,972 | B2 * | 9/2013 | Hofsaess | H01H 37/5427 337/381 |
| 10,541,096 | B2 | 1/2020 | Hofsaess | |
| 11,069,501 | B2 * | 7/2021 | Wang | H01H 85/0411 |
| 2004/0041681 | A1 * | 3/2004 | Oh | H01H 81/02 337/112 |
| 2006/0127686 | A1 * | 6/2006 | Meloni | C08K 3/38 428/473.5 |
| 2013/0127586 | A1 | 5/2013 | Hofsaess | |
| 2015/0366113 | A1 * | 12/2015 | Sreetharan | E05D 11/0081 16/225 |
| 2017/0062160 | A1 * | 3/2017 | Hofsaess | H01H 37/54 |

FOREIGN PATENT DOCUMENTS

| | | | | |
|---|---|---|---|---|
| DE | 102009039948 | A1 | 3/2011 | |
| DE | 102011119633 | B3 | 4/2013 | |
| DE | 102011122890 | A1 | 5/2013 | |
| DE | 102013102006 | A1 | 8/2014 | |
| DE | 102013102089 | A1 | 9/2014 | |
| DE | 102015114248 | B4 | 1/2019 | |
| EP | 1239505 | A2 | 9/2002 | |
| EP | 2597661 | A1 | 5/2013 | |
| FR | 2798935 | A1 * | 3/2001 | B29C 66/82661 |
| JP | 2004087485 | A * | 3/2004 | H01H 37/5427 |
| JP | 2004087485 | A | 3/2004 | |
| WO | WO02086927 | A1 | 10/2002 | |

OTHER PUBLICATIONS

Krause Dieter, Apr. 5, 2001, Siemens AG, Entire Document (Translation of FR 2798935, English Translation of Abstract shown in German Equivalent Document since No. English Translation for the Abstract could be found in the French Document). (Year: 2001).*

European Search Opinion filed in the EPO dated Apr. 30, 2021 (Year: 2021).*

Search Report issued by the European Patent office for application 20206380.6 dated Apr. 30, 2021; 8 pages.

Office action issued by the German Patent office for application 102019132433.5 dated Nov. 13, 2020; 6 pages.

Office action issued by the Japanese Patent Office for application 2020-191337 dated Feb. 7, 2022, 8 pages.

* cited by examiner

TEMPERATURE-DEPENDENT SWITCH

CROSS REFERENCE TO RELATED APPLICATIONS

This application claims priority from German patent application DE 10 2019 132 433.5, filed on Nov. 29, 2019. The entire content of this priority application is incorporated herein by reference.

BACKGROUND

This disclosure relates to a temperature-dependent switch and a method of manufacturing a temperature-dependent switch.

An exemplary temperature-dependent switch is disclosed in DE 10 2015 114 248 B4.

Such temperature-dependent switches are usually used to monitor the temperature of a device. For this purpose it is, for example, brought into thermal contact through its external surfaces with the device to be protected, so that the temperature of the device to be protected affects the temperature of the switching mechanism.

The switch is typically connected electrically in series in the power supply circuit of the device to be protected by means of connecting wires soldered to its two external contact surfaces so that the supply current to the device to be protected flows through the switch when below the response temperature of the switch.

The switch comprises a lower part, in which an internal, circumferential shoulder is provided, on which the cover part rests either directly or with the interposition of an insulating foil. The cover part is held firmly against this circumferential shoulder through a circumferential raised wall of the lower part, whose upper section is bent radially inwards.

The temperature-dependent switching mechanism of the switch disclosed in DE 10 2015 114 248 B4 comprises a snap-action spring disc, which carries a movable contact part, as well as a bimetal snap-action disc which is put over the movable contact part. The snap-action spring disc presses the movable contact part against a stationary counter-contact inside on the cover part. The snap-action spring disc is supported by its edge in the lower part of the housing, so that the electrical current flows from the lower part through the snap-action spring disc and the movable contact part into the stationary counter-contact, and from there into the cover part.

In design variants of the switch disclosed in DE 10 2015 114 248 B4, a bimetal part or a bimetal snap-action disc, which lies force-free in the switching mechanism when below its switching temperature, is provided for the temperature-dependent switching function.

In the context of this disclosure, a bimetal part or a bimetal snap-action disc refers to a multi-layer, active, sheet-like component of two, three or four inseparably bonded components with different coefficients of thermal expansion. The joins between the individual layers of metal or metal alloy are materially bonded or form-fitted, and are, for example, fabricated by rolling.

Such a bimetal part has a first stable geometric configuration in its low temperature position and a second stable geometric configuration in its high temperature position, between which positions it switches depending on the temperature in a hysteresis-like manner. If the temperature changes beyond its response temperature or below its return temperature, the bimetal part snaps over to the other geometric configuration. The bimetal part is therefore often referred to as a snap-action disc, wherein it typically has an elongated, oval or circular shape when viewed from above.

If the temperature of the bimetal part, which is typically designed as a bimetal disc, rises above the response temperature as a result of a rise in temperature of the device to be protected, the bimetal disc snaps from its low-temperature configuration to its high-temperature configuration. The bimetal disc thereby acts against the snap-action spring disc in such a way that it lifts the movable contact part from the stationary counter-contact or the current transfer member from the two stationary counter-contacts, so that the switch opens and the device to be protected is switched off and can no longer heat up.

In these designs, the bimetal disc is preferably mounted mechanically force-free below its transition temperature, wherein the bimetal disc is also not used to carry the current. This has the advantage that the bimetal disc exhibits a longer mechanical service life and that the switching point, that is the transition temperature of the bimetal disc, does not change even after a large number of switching operations.

If the requirements for the mechanical reliability and/or the stability of the response temperature are low, the bimetal disc can also take over the function of the snap-action spring disc and, potentially, also of the current transfer member, so that the switching mechanism comprises only one bimetal disc, which then carries the movable contact part or comprises two contact surfaces instead of the current transfer member. In this case, the bimetal disc not only provides the closing pressure of the switch, but also carries the current when the switch is in the closed state.

In most temperature-dependent switches, the housing is usually protected against the ingress of contamination by a seal, which is applied before or after joining the connecting lugs or connecting cables to the external terminals.

Molding the external terminals with a single-component thermosetting plastic is disclosed in DE 41 39 091 A1. Casting the connecting lugs with an epoxy resin is furthermore disclosed in DE 10 2009 039 948 A1. It is also known to apply an impregnating varnish or protective varnish to the switches after soldering to the connecting cables or connecting lugs.

To prevent varnish, resin or other liquids from penetrating into the inside of the housing, the cover part of the switch disclosed in DE 196 23 570 A1 is provided with a sealing means in the form of a circumferential bead which runs radially outside on the lower side of the cover part. When the upper section of the circumferential wall of the lower part is bent, this circumferential bead constricts the insulating foil. While this does provide better sealing, in many cases varnish nevertheless does penetrate into the inside of the housing. The insulating foil lying between the lower part and the cover part is pulled up laterally between the wall of the lower part and the cover part, and its edge section is bent over onto the upper side of the cover part. The stiff insulating foil becomes rippled by the bending over, and forms rosettes which cannot be reliably sealed by the upper section of the circumferential wall of the lower part that is pressed flat onto them. There is a risk that the finishing varnish penetrates inside the switch through the rosettes. DE 196 23 570 A1 attempts to reduce this problem through the bead that has already been mentioned.

DE 10 2013 102 089 B4 describes a switch as it is known in principle from DE 196 23 570 A1. This switch comprises a spacer ring between the shoulder in the lower part and the cover part, which permits a larger contact gap between the movable contact part and the stationary counter-contact. To overcome the sealing problem known from the switch disclosed in DE 196 23 570 A1, the edge region of the insulating foil in this switch is given V-shaped incisions from the outside, whereby the ripple is greatly reduced, so improving the sealing.

DE 10 2013 102 006 B4 also describes a switch of similar design. This switch comprises a cover part of positive temperature coefficient material (PTC material). Due to the poor resistance to compression of this PTC cover, the radially inwardly bent upper section of the circumferential wall of the lower part cannot provide sufficient sealing against the ingress of contamination, for which reason the bent upper section of the circumferential wall must be sealed against the upper side of the cover part with silicone, which leads frequently to problems. DE 10 2013 102 006 B4 solves this problem in that a covering foil is provided which only lies on the upper side of the PTC cover, and into which the upper section of the circumferential wall of the lower part which is bent and lies flat against the covering foil, penetrates. The front side of the upper section of the circumferential wall faces away from the covering foil. However, the upper section of the circumferential wall of the lower part, which is lying flat, frequently does not provide the desired sealing.

A switch can also be equipped with a covering foil and an insulating foil, as is illustrated, e.g., by DE 10 2013 102 089 B4. An insulating covering foil, e.g. made of Nomex®, is arranged on the upper side of the cover part of this switch, extending with its edge radially outwards as far as the insulating foil, which consists, e.g., of Kapton®. Nomex® and Kapton® consist of aramid paper and of aromatic polyimides, respectively.

In spite of the various sealing measures, sealing problems continue to occur, due in part to the fact that, as a result of the bending of the upper section of the circumferential edge of the lower part, the relatively stiff insulating foil cannot achieve a lasting seal.

In the case of the switch disclosed in DE 10 2015 114 248 B4 mentioned at the outset, this sealing problem is solved by a circumferentially closed cutting burr formed integrally with the shoulder in the lower part, wherein this cutting burr penetrates into the insulating foil (if present) from below or directly into the cover part from below. By the penetration of this circumferentially closed cutting burr into the insulating foil or the cover part, a secure seal is achieved between the lower part and the cover part.

The cutting burr is generated during the production of the lower part. It is formed integrally with the shoulder in the lower part. In this case, the lower part is usually produced as a turned part, so that the cutting burr is a turning groove which is generated during the turning of the lower part.

However, in order to ensure sufficient tightness, this turning groove must be manufactured very precisely. A production of the lower part including this turning groove that is to be manufactured precisely is very complex and thus increases the production costs. A further problem of this solution is that the turning grooves are often damaged before the switch is mounted. The individual parts of the switch housing are typically stored as bulk material before they are assembled. It can easily happen that the turning grooves are blunted or even completely rubbed off.

SUMMARY

It is an object to eliminate or at least to reduce the above-mentioned sealing problems in a structurally simple and inexpensive way.

According to a first aspect, a temperature-dependent switch is provided, which comprises:

- a housing having a cover part and a lower part;
- an insulating foil arranged between the cover part and the lower part;
- a first external contact surface provided externally on the housing;
- a second external contact surface provided externally on the housing; and
- a temperature-dependent switching mechanism that is arranged in the housing, and that, depending on its temperature, establishes or opens an electrically conductive connection between the first external contact surface and the second external contact surface;
- wherein the insulating foil is at least partially coated or printed with a sealing agent that contacts the cover part and/or the lower part in a sealing area According to a second aspect, a method for manufacturing a temperature-dependent switch is provided, comprising:

- providing a housing having a lower part and a cover part;
- providing a temperature-dependent switching mechanism which, as a function of its temperature, establishes or opens an electrically conductive connection between a first external contact surface provided externally on the housing and a second contact surface provided externally on the housing,
- providing an insulating foil;
- coating or printing at least a portion of the insulating foil with a sealing agent; and
- mounting the housing, wherein the switching mechanism is arranged in the housing and the cover part is mounted on the lower part with the insulating foil interposed between the cover part and the lower part in such a way that the sealing agent for sealing the housing contacts the cover part and/or the lower part in a sealing area.

By coating or printing the insulating foil with a sealing agent, the sealing of the inside of the housing can be significantly improved. In this case, the insulating foil does not only serve to electrically insulate the cover part from the lower part of the housing. Due to the coating of the insulating foil with the sealing agent, insulating foil also has a high mechanical sealing effect. The danger that paint, resin or other liquids get into the inside of the housing during the production of the switch is thereby considerably reduced.

The additional sealing agent applied to the insulating foil ensures a thorough seal. Without the sealing agent, the insulating foil seals with known switches only due to the positive locking fit or due to the contact pressure occurring between the cover part and the lower part and the insulating foil arranged in between.

A further advantage of the herein presented solution is the very simple handling for applying the sealing agent to the housing of the switch. Due to the fact that the sealing agent is already applied to the insulating foil before the switch is mounted, the insulating foil can be easily applied between the cover part and the lower part of the housing as usual. An additional work step, as it would be necessary to apply a separate sealing agent, can be omitted. The positions at which the insulating foil is clamped between the cover part and the lower part when the switch is mounted. Accordingly, the sealing agent can be applied to the insulating foil at the appropriate positions already before the insulating foil is mounted in order to contact the cover part and/or the lower part of the housing as desired in the sealing area after mounting.

In general, it is preferred that the sealing agent is only partially applied to the insulating foil in this sealing area. In principle, however, it is also conceivable to coat or print the whole insulating foil with the sealing agent.

For the application of the sealing agent on the insulating foil, various common coating methods can be used, such as varnishing, spray coating, vapor deposition, etc. Various printing techniques known from the prior art are also possible.

According to a preferred refinement, the sealing agent is made of plastic or wax.

In addition to their low-cost procurement option, various plastics or waxes have the advantage that they can be relatively viscous at room temperature, so that they do not melt when the insulating foil is installed in the switch and thus do not flow into unwanted areas. Particularly wax adheres relatively well to the insulating foil, so that the risk of the sealing agent separating from the insulating foil during installation of the insulating foil is relatively low. In addition, wax adapts very well to different shapes, which is particularly advantageous for edges or corners to be sealed, as the wax, together with the insulating foil, adapts to the respective shape of the cover part and/or lower part. This ensures an optimal sealing effect.

According to a further refinement, the sealing agent is made of a thermoplastic, a thermoset or an elastomer.

Furthermore, it is preferred that the sealing agent is a sealing agent that is retroactively activated by heating and that was activated after its installation in the housing. In the method, it is accordingly preferred that the switch is heated to activate the sealing agent after mounting the housing.

Such subsequent heating of the switch allows, for example, a part of the sealing agent to be liquefied in order to reach the desired positions to be sealed even better. Compared to a sealing agent that is already liquid from the beginning, the handling of such a sealing agent that is subsequently activated by heating when the switch is mounted is much easier. Sealing agents that are liquid from the very beginning would possibly flow into unwanted areas during the installation of the insulating foil and lead to contamination and/or other mounting complications.

According to another refinement, the insulating foil comprises a polyimide or an aromatic polyamide. Preferably, the insulating foil consists of a polyimide or an aromatic polyamide.

The positive suitability of such materials for insulating foils in temperature-dependent switches has already been proven many times in practice. Typically, insulating foils for this type of application are made of materials with trade names such as Kapton® or Nomex®.

The thickness of the insulating foil can vary depending on the application. In the case of a comparatively large thickness, it is often referred to as "insulating disc". However, such an insulating disc is herein also subsumed under the term "insulating foil".

According to a further refinement, it is preferred that the sealing agent forms a closed, preferably circular contour on the insulating foil.

The closed contour of the sealing agent has the advantage that a sealing effect can be created along the entire circumference of the switch by means of the sealing agent applied to the insulating foil. Typically, such temperature-dependent switches are switches with rotationally symmetrical housings, so that a sealing effect is required along the entire circumference of the housing.

The contour of the sealing agent is preferably adapted to the shape of the housing. Thus, the sealing agent does not necessarily have to be applied to the insulating foil in a circular shape, but can also be applied to the insulating foil in an elliptical or oval area, for example if the housing also has a corresponding shape.

According to a further refinement, the insulating foil comprises a centrally arranged hole that is surrounded by the closed contour.

Preferably, the sealing agent is arranged at a distance from the central hole. A part of the switching mechanism of the switch can protrude through the hole in the insulating foil to create an electrically conductive connection between the cover part and the lower part of the switch.

The sealing agent is preferably radially spaced in relation to this hole, as its sealing effect is particularly required in a sealing area that is located in the area of the edge of the cover part, since the insulating foil is folded or bent here and, especially at these positions, a kind of rosette formation of the insulating foil can occur which can lead to mechanical leaks without the sealing agent.

According to a refinement, the insulating foil is coated or printed with the sealing agent on one side, either on its upper side facing the cover part or on its lower side facing the lower part.

Such a one-sided coating of the insulating foil is cost-effective and may already be sufficient for the desired sealing effect. This is particularly the case if, in addition to the sealing agent applied to the insulating foil, there are other devices for sealing the inside of the housing.

According to a refinement, it is provided, for example, that the insulating foil is coated or printed with the sealing agent on one side, namely on its upper side facing the cover part, and that a circumferentially closed cutting burr is provided on the lower part, which cutting burr penetrates into a lower side of the insulating foil opposite the upper side.

Such a cutting burr, which can be designed as a turning groove, for example, is disclosed in DE 10 2015 114 248 B4. In combination with the sealing agent coating of the insulating foil, such a cutting burr, which cuts into the insulating foil from the side opposite the sealing agent, can ensure optimum sealing of the interior of the housing.

It goes without saying, that the combination of sealing agent coatings and cutting burr can, however, also be used in reverse arrangement at the switch. For example, it may be provided that the insulating foil is coated or printed with the sealing agent on one side, namely on its lower side facing the lower part, and that a circumferentially closed cutting burr is formed on the cover part, which penetrates or cuts into an upper side of the insulating foil opposite the lower side.

According to a further refinement, it is provided that the insulating foil is coated or printed with the sealing agent on both sides, both on its upper side facing the cover part and on its lower side facing the lower part.

This has particular cost advantages compared to the combined solution of sealing agent coating and cutting burr. It has been found that such a double-sided coating of the insulating foil with sealing agent can also achieve a very good seal. The sealing agent applied to the upper side of the insulating foil provides the seal between the insulating foil and the cover part of the housing. The sealing agent applied to the lower side of the insulating foil, on the other hand, provides the seal between the insulating foil and the lower part of the housing. This ensures an appropriate seal on both sides of the insulating foil.

Preferably, one edge of the cover part presses on the lower part in the sealing area and the intermediate layer of the insulating foil.

In other words, the sealing agent is preferably arranged on the insulating foil in such a way that it is located in the completely assembled switch in an area where the cover part presses on the lower part. This pressure is typically the closing pressure with which the cover part is pressed onto the lower part when the switch is assembled. This pressure can lead to plastic deformation of the sealing agent, which further improves the sealing effect of the sealing agent.

It is preferably provided that the lower part comprises a circumferential wall, the upper section of which overlaps the cover part, that a circumferential shoulder is provided in the lower part, on which shoulder the cover part rests with the insulating foil interposed there between, wherein the upper section of the lower part presses the cover part onto the circumferential shoulder, and that the sealing area is arranged on the circumferential shoulder and/or on a lower edge of the cover part facing the circumferential shoulder.

The greatest deformation of the insulating foil occurs in the area of this shoulder or in the area of the lower, radially outer edge of the cover part. Especially in this area, a kind of wrinkle and/or rosette formation can occur in the insulating foil, which can considerably impair the sealing effect. Thus, the sealing agent coating on the insulating foil leads to an immense advantage, especially in this area, since the sealing agent can counteract the aforementioned wrinkle and/or rosette formation in this area, or since the sealing agent can provide for a sealing of this sealing area despite these wrinkles or rosettes.

It is also preferred that the switching mechanism carries a movable contact part that interacts with a stationary counter contact, which is arranged on a lower side of the cover part facing the lower part and interacts with the first external contact surface. The movable contact part moves together with the switching mechanism during a switching operation. In the low-temperature position of the switching mechanism, the movable contact part is pressed against the stationary counter contact. The electric circuit is then closed via the switch. In the low-temperature position of the switching mechanism the movable contact part is lifted off the stationary counter contact. The electric circuit is then open.

Regardless of the design variant of the switch, it is preferred that the switching mechanism comprises a bimetal part. The bimetal part can be a round, preferably circular bimetal snap-action disc, although it is also possible to use an elongated bimetal spring clamped on one side as the bimetal part. With simple switches, the bimetal part can also be used to conduct current.

It is also preferred that the switching mechanism additionally comprises a snap-action spring disc. This snap-action spring disc can, for example, support the moveable contact part and conduct the current through the closed switch and provide the contact pressure when closed. In this way, the bimetal part is relieved of both the current flow and the mechanical load when the switch is closed.

The housing may have a round, circular or oval shape in plan view. In principle, however, other housing shapes can be used as well.

It goes without saying that the features referred to above and yet to be explained below can be used not only in the respective given combinations, but also in other combinations or alone without leaving the spirit and scope of the present disclosure.

DESCRIPTION OF PREFERRED EMBODIMENTS

Figure 1:
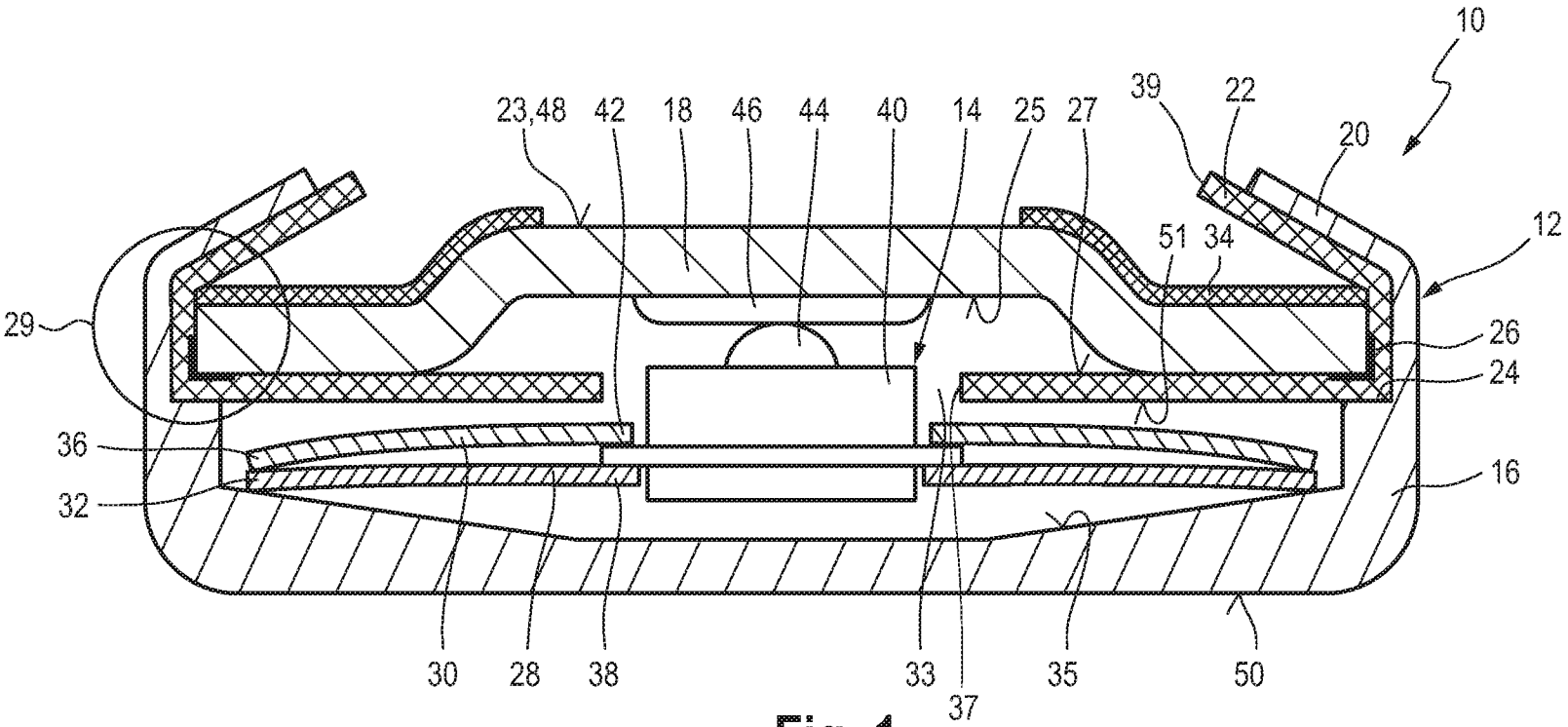
FIG. 1 a schematic sectional view of a first embodiment of the switch in a first switching position.

FIG. 1 shows a schematic sectional side view of a switch 10, which is rotationally symmetrical in top view and preferably has a circular shape.

The switch 10 comprises a housing 12, in which a temperature-dependent switching mechanism 14 is arranged. The housing 12 comprises a pot-like lower part 16 and a cover part 18, which is held on the lower part 16 by a bent or flanged rim 20.

Both the lower part 16 and the cover part 18 are made of an electrically conductive material, preferably metal. The cover part 18 rests on a shoulder 24 inside the lower part 16, with an insulating foil 22 interposed there between. The upper edge 20 of the lower part 16 is bent radially inwards in such a way that it presses the cover part 18 onto the circumferential shoulder 24 with the insulating foil 22 interposed there between.

The insulating foil 22 provides an electrical insulation of the cover part 18 against the lower part 16 and includes a circumferential inner edge 37 arranged inside the housing and a circumferential outer edge 39 arranged outside the housing. In addition, the insulating foil 22 also provides a mechanical seal that prevents liquids or impurities from entering the inside of the housing from the outside.

The insulating foil 22 runs inside the housing 12 parallel to the cover part 18 along the lower side 25 of the cover part, from where it is led laterally between the cover part 18 and the circumferential shoulder 24 up to the upper side 23 of the cover part 18 and out of the housing 12. The bent or flanged upper edge 20 of the lower part 16 lies flat on the upper edge section of the insulating foil 22 and presses it towards the upper side 23 of the cover part 18.

The insulating foil 22 is coated with a sealing agent 26. The sealing agent 26 is preferably a plastic (thermoplastic, thermoset or elastomer) or a wax.

In the first embodiment of the switch 10 shown in FIG. 1, the sealing agent 26 is applied to an upper side 27 of the insulating foil 22 facing the cover part 18. In the mounted state of the switch 10, the sealing agent 26 contacts the cover part 18 in a sealing area 29. This sealing area 29 is highlighted in FIG. 1 by a circle.

In this embodiment, the sealing area 29 extends circumferentially along the outer, lower edge of the cover part 18 and, from there, a bit vertically upwards along the outer circumference of the cover part 18 and radially inwards along a radially outer part of the lower side 25 of the cover part 18. Seen in the cross-section, the sealing agent 26 is thus essentially L-shaped.

Figure 7:
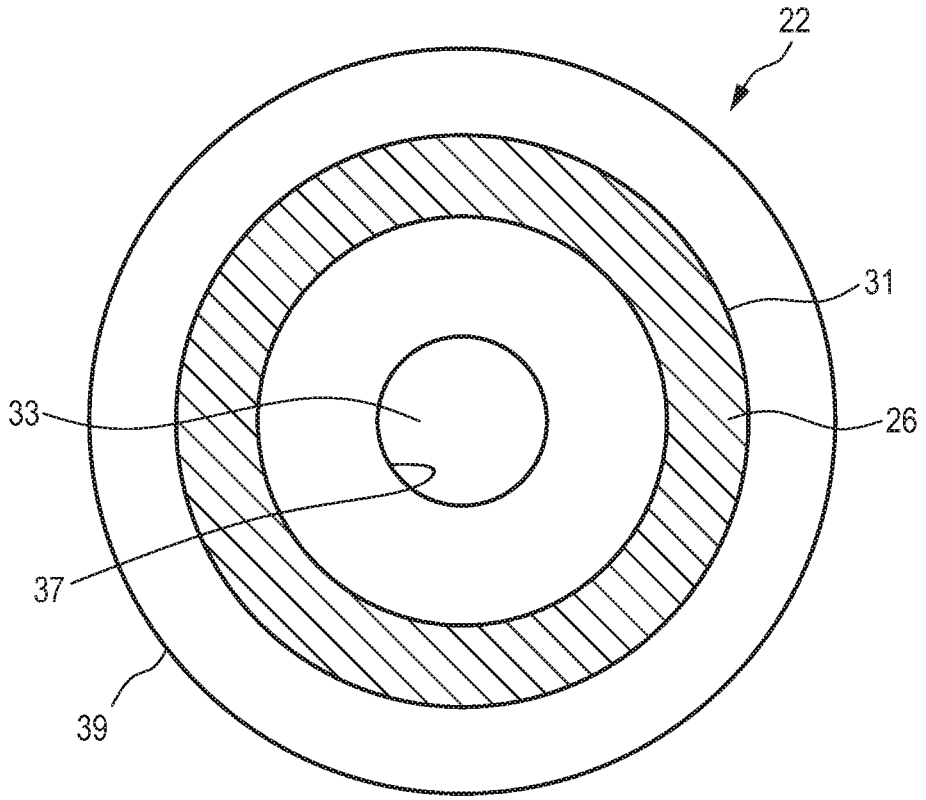
FIG. 7 a schematic top view of an insulating foil that can be used in the switch.

FIG. 7 shows a schematic top view of the insulating foil 22 from above, which includes a circumferential inner edge 37 and a circumferential outer edge 39. As can be seen, the sealing agent 26 is applied to the insulating foil 22 in an annular area 31. Sealing agent 26 preferably forms a closed contour. This ensures a seal along the entire circumference between the cover part 18 and the lower part 16. It goes without saying that, depending on the shape of the insulating foil 22, the area 31 does not necessarily have to be circular, but can also be oval or elliptical, for example.

The area 31 where the sealing agent 26 is applied to the insulating foil 22 is positioned in such a way that the sealing agent 26 is automatically arranged in the desired sealing area 29 when the insulating foil 22 is mounted in the housing 12. The area 31 is preferably located at a radial distance from a hole 33 that is arranged centrally in the insulating foil 22. This hole 33 allows a part of the temperature-dependent switching mechanism of the switch 10 to move through the insulating foil 22, as explained in more detail below.

The sealing agent 26 is preferably a sealing agent that is retroactively activated by heating and is only activated after it has been installed in housing 12. This means that the switch 10 is preferably slightly heated in an oven after installation of the insulating foil 22, which causes at least part of the sealing agent 26 to melt or at least partially liquefy in order to adapt even better to the shape of the insulating foil 22 and the shape of the cover part 18 in the sealing area 29. Subsequent cooling causes the sealing agent 26 to solidify again. This considerably improves the sealing effect of the sealing agent 26. The sealing agent 26 ensures a thorough seal in the sealing area 29.

On the upper side 23 of the cover part 18, the switch 10 shown in FIG. 1 is further provided with a further insulating cover 34, which extends radially outwards from a central area to the insulating foil 22.

The switching mechanism 14 comprises a temperature-independent spring part 28, which is designed as a snap-action spring disc, and a temperature-dependent bimetal part 30, which is designed as a bimetal snap-action disc. The spring part 28 is preferably designed as a bistable spring disc. Accordingly, the spring disc 28 has two temperature-independent stable geometric configurations. The first geometric configuration is shown in FIG. 1.

The temperature-dependent bimetal disc 30 is preferably designed as a bistable snap-action disc. The bimetal disc 30 has two temperature-dependent configurations, a geometrical high-temperature configuration and a geometrical low-temperature configuration. In the first switching position of the switching mechanism 14 shown in FIG. 1, the bimetal disc 30 is in its low-temperature configuration.

The snap-action spring disc 28 rests with its edge 32 on an inner bottom surface 35 of the lower part 16. The inner bottom surface 35 is substantially concave in shape and is slightly raised at the point where the edge 32 of the snap-action spring disc 28 rests in the first switching position shown in FIG. 1, compared to the central area of the inner bottom surface 35. The bimetal disc 30 rests with its edge 36 on the snap-action spring disc 28 in the low-temperature configuration shown in FIG. 1.

The snap-action spring disc 28 is fixed with its center 38 to a movable contact member 40 of the switching mechanism 14. The bimetal disc 30 is also fixed with its center 42 to this contact member 40. In this way, the temperature-dependent switching mechanism 14 is a captive unit comprising the contact member 40, snap-action spring disc 28 and bimetal disc 30. When mounting the switch 10, the switching mechanism 14 can thus be inserted as a unit directly into the lower part 16.

On its upper side, the movable contact member 40 comprises a movable contact part 44. The movable contact part 44 interacts with a stationary counter-contact 46, which is arranged at the lower side 25 of the cover part 18. In this embodiment, the upper side 23 of the cover part 18, which is connected to the stationary counter-contact 46 in an electrically conductive manner, serves as first external contact surface 48. The outer side of the lower part 16 serves as second external contact surface 50. For example, the outer bottom surface or the outer side of the bent upper edge 20 of the lower part 16 can serve as second external contact surface 50.

In the closed switching position of the switch 10 shown in FIG. 1, the movable contact part 44 is pressed against the stationary counter contact 46 by the snap-action spring disc 28. Since the electrically conductive snap-action spring disc 28 is, with its edge 32, in contact with the lower part 16, an electrically conductive connection is established between the two external contact surfaces 48, 50.

Figure 2:
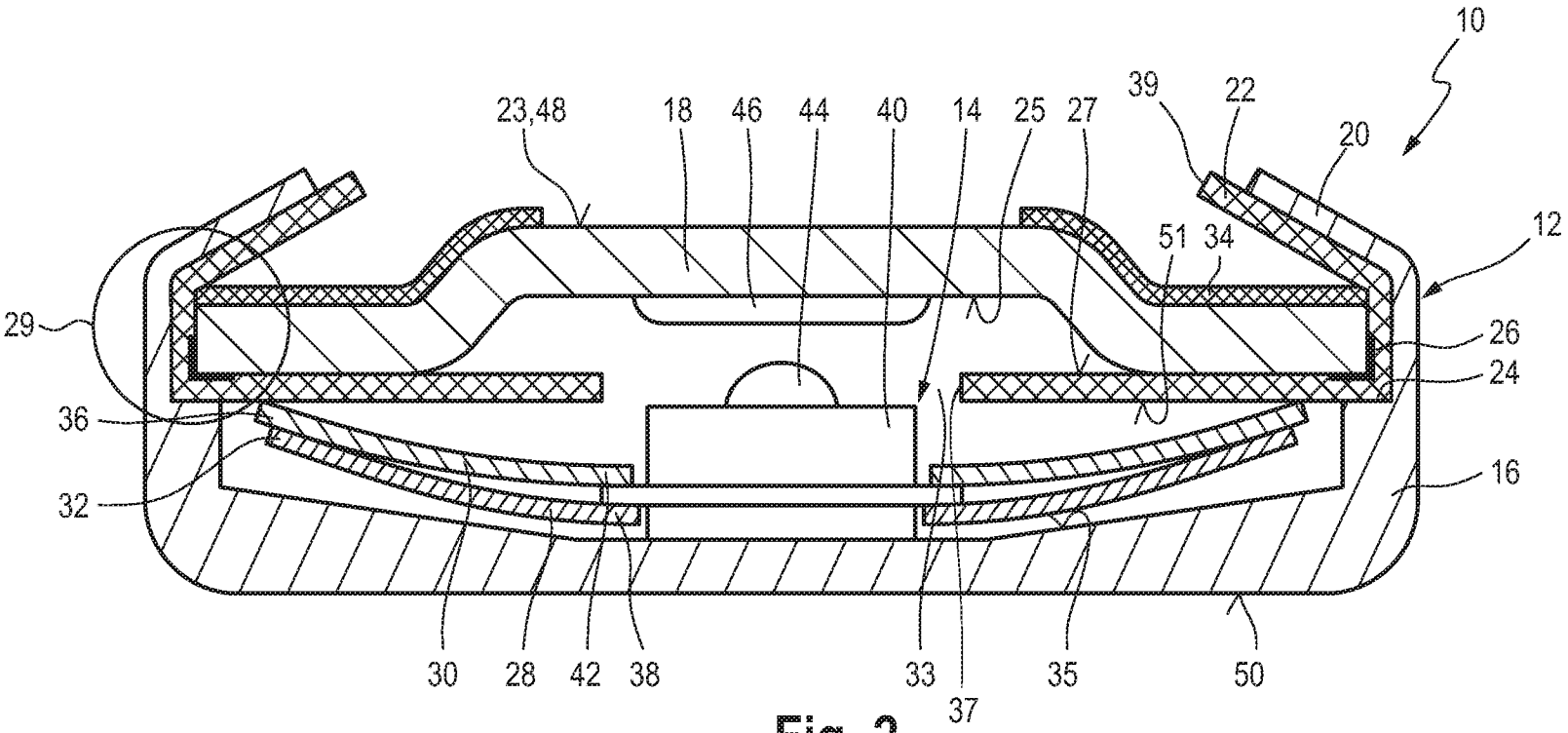
FIG. 2 a schematic sectional view of the first embodiment of the switch shown in FIG. 1, in a second switching position.

If the temperature inside the switch 10 now increases above the switching temperature of the bimetal disc 30, the latter snaps from its convex low-temperature configuration shown in FIG. 1 to its concave high-temperature configuration shown in FIG. 2.

In the high-temperature configuration shown in FIG. 2, the bimetal disc 30 is with its edge 36 supported on the lower side 51 of the insulating foil 22 and pushes the movable contact member 40 downwards with its center 42. This lifts the movable contact member 44 off the stationary counter contact 46. The snap-action spring disc 28 thereby snaps from its first geometrically stable configuration shown in FIG. 1 to its second geometrically stable configuration shown in FIG. 2.

Since the switch is now open and the power supply to the device to be protected is interrupted, the device to be protected and thus also switch 10 can cool down again. When the temperature inside the switch 10 then cools down to a temperature below the reset temperature of the bimetal disc 30, it snaps back from its high-temperature configuration shown in FIG. 2 into its low-temperature configuration shown in FIG. 1. The snap-action spring disc 28 also snaps back into its first geometrically stable configuration and brings the movable contact part 44 back into contact with the stationary counter contact 46. The switch 10 or the electric circuit is then closed again.

Figure 3:
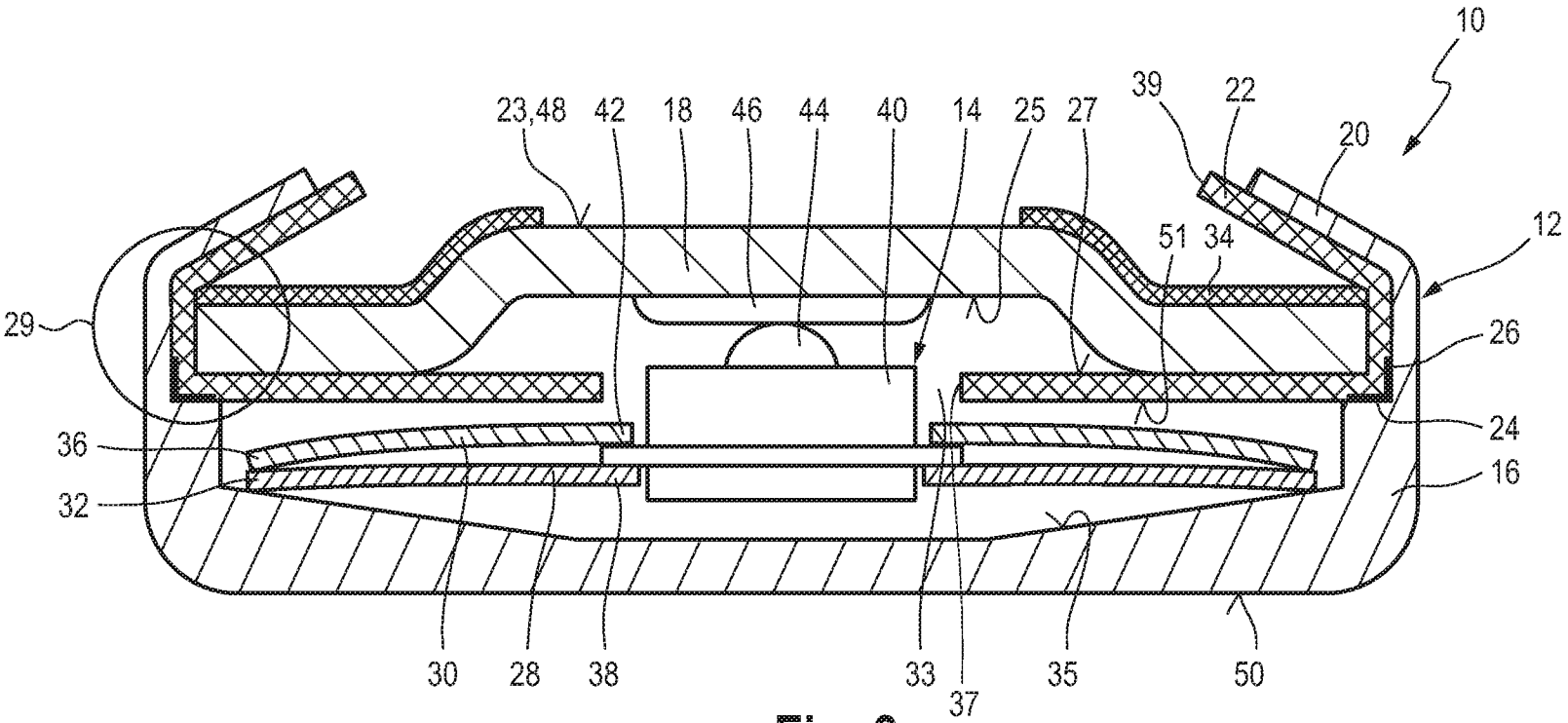
FIG. 3 a schematic sectional view of a second embodiment of the switch in the first switching position.

FIG. 3 shows a second embodiment of the switch 10, which is shown in its first position. In comparison to the first embodiment of the switch 10 shown in FIGS. 1 and 2, the sealing agent 26 is now applied to the lower side 51 of the insulating foil 22 facing the lower part 16 and seals in the sealing area 29, especially between the insulating foil 22 and the lower part 16 of the housing 12.

Figure 4:
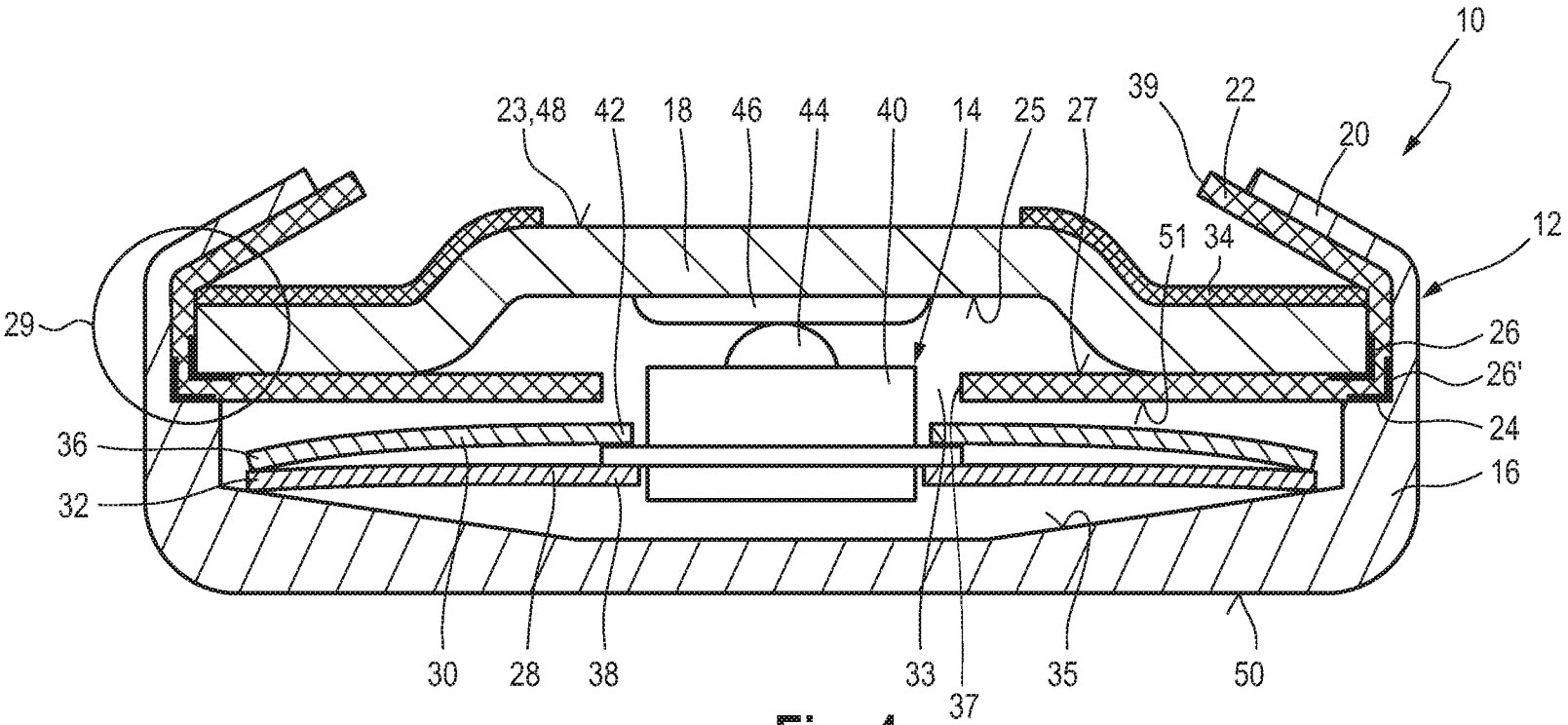
FIG. 4 a schematic sectional view of a third embodiment of the switch in the first switching position.

In the third embodiment of the switch 10 shown in FIG. 4, the insulating foil 22 is coated not only on one side, but on both sides with a sealing agent 26, 26'. Accordingly, the sealing agent 26, 26' is applied to both the upper side 27 facing the cover part 18 and the lower side 51 of the insulating foil 22 facing the lower part 16. Preferably, the sealing agent 26, 26' is applied to both sides of the insulating foil 22 in an annular area 31. This further improves the sealing effect, as the sealing agent 26, 26' in the sealing area 29 seals both the area between the outer lower edge of the cover part and the insulating foil as well as the area between the insulating foil 22 and the circumferential shoulder 24 of the lower part 16.

Figure 5:
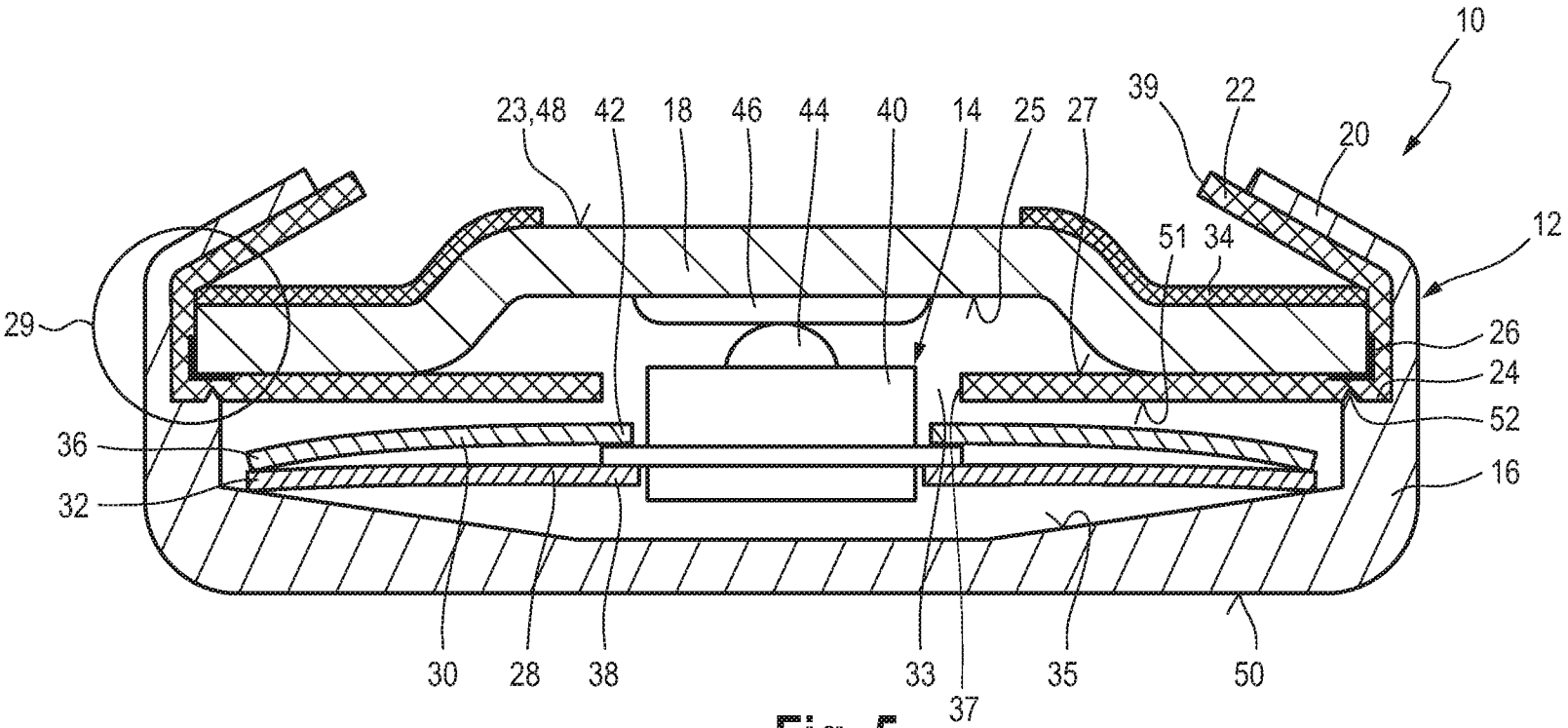
FIG. 5 a schematic sectional view of a fourth embodiment of the switch in the first switching position.

FIG. 5 shows a further embodiment of the switch 10. Again, the switch 10 is shown here in its first, closed switching position. In the embodiment shown in FIG. 5, the sealing agent 26 is applied again to the upper side 27 of the insulating foil 22, similar to the first embodiment shown in FIGS. 1 and 2. On the lower side 51 of the insulating foil 22, a cutting burr 52 provides an additional seal between the insulating foil 22 and the lower part 16. This cutting burr 52 is configured as a circumferential cutting burr with a closed contour. The cutting burr 52 is preferably configured as a turning groove, which is arranged on the upper side of the shoulder 24. The cutting burr 52 is preferably formed integrally with the lower part 16. On its upper side, the cutting burr has a pointed cutting edge with which the cutting burr 52 penetrates the lower side 51 of the insulating foil 22. The cutting burr 52 thus cuts at least partially into the insulating foil 22 and thus provides a mechanical barrier. In combination with the sealing agent 26 arranged on the upper side 27 of the insulating foil 22, the cutting burr 52 ensures a very good seal on both sides of the insulating foil 22.

Figure 6:
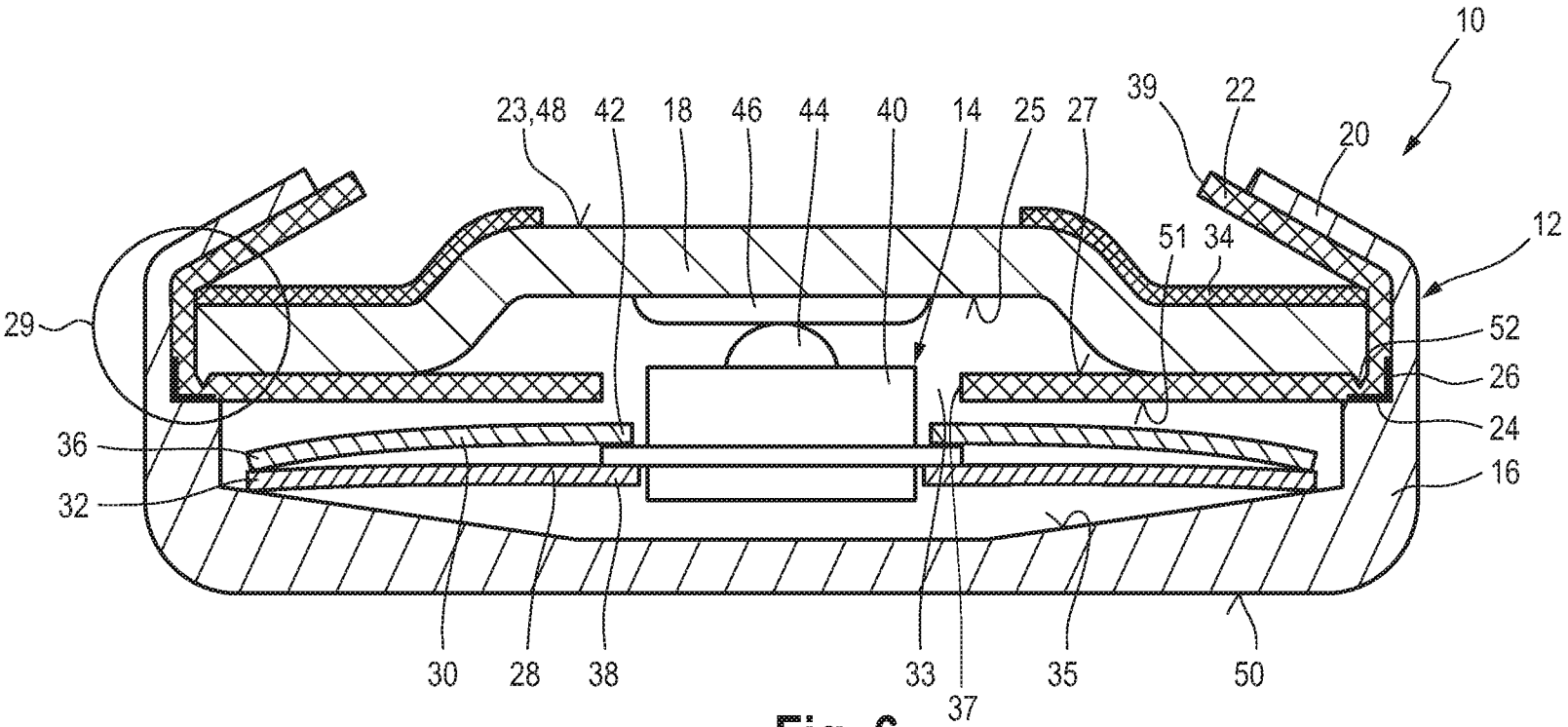
FIG. 6 a schematic sectional view of a fifth embodiment of the switch in the first switching position.

The position of the sealing agent 26 and the cutting burr 52 may be reversed in contrast to the embodiment shown in FIG. 5. Such an embodiment is shown in FIG. 6. Here, the cutting burr 52 is arranged at the cover part 18 and the sealing agent 26 is arranged at the lower side 51 of the insulating foil 22. The cutting burr 52 cuts into the upper side 27 of the insulating foil 22 from above and seals the sealing area 29 between the cover part 18 and the insulating foil 22, whereas the sealing agent 26 seals the sealing area 29 between the insulating foil 22 and the lower part 16.

Furthermore, it is also possible to arrange the cutting burr 52 and the sealing agent 26 on the same side of the insulating foil 22. The cutting burr 52 would then cut into a part of the sealing agent 26. This would also result in a very good sealing effect. For example, it would be possible to provide such a cutting burr 52 on both the lower part 16 and the cover part 18 so that one cutting burr 52 would then penetrate into the insulating foil 22 from below and a second cutting burr would penetrate into the insulating foil 22 from above. In this case, the sealing agent 26, 26' could also be arranged on both sides of the insulating foil 22 as shown in FIG. 4.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A temperature-dependent switch, comprising:

a housing having a cover part and a lower part;

an insulating foil arranged between the cover part and the lower part, having a circumferential inner edge arranged inside the housing and a circumferential outer edge arranged outside the housing;

a first external contact surface provided externally on the housing;

a second external contact surface provided externally on the housing; and a temperature-dependent switching mechanism that is arranged in the housing, and that, depending on its temperature, establishes or opens an electrically conductive connection between the first external contact surface and the second external contact surface;

wherein, on at least one of a lower side of the insulating foil facing the lower part of the housing or an upper side of the insulating foil facing the cover part of the housing, the insulating foil is only partially coated or printed with a sealing agent in a sealing area where the insulating foil is clamped between the lower part of the housing and the cover part of the housing, the sealing agent forms a closed contour on the insulating foil and is spaced from the circumferential inner edge as well as from the circumferential outer edge.

2. The temperature-dependent switch according to claim 1, wherein the sealing agent comprises a plastic or wax.

3. The temperature-dependent switch according to claim 1, wherein the sealing agent comprises a thermoplastic, a thermoset or an elastomer.

4. The temperature-dependent switch according to claim 1, wherein the sealing agent is configured to be retroactively activated by heating after having been installed in the housing.

5. The temperature-dependent switch according to claim 1, wherein the insulating foil comprises a polyimide or an aromatic polyamide.

6. The temperature-dependent switch according to claim 1, wherein the insulating foil comprises a central hole that is surrounded by the sealing agent.

7. The temperature-dependent switch according to claim 1, wherein the insulating foil is coated or printed with the sealing agent on the upper side of the insulating foil facing the cover part of the housing, and wherein a cutting burr is provided on the lower part of the housing, wherein the cutting burr penetrates into the lower side of the insulating foil.

8. The temperature-dependent switch according to claim 1, wherein the insulating foil is coated or printed with the sealing agent both on the upper side of the insulating foil and on the lower side of the insulating foil.

9. The temperature-dependent switch according to claim 1, wherein, in the sealing area, an edge of the cover part of the housing presses or is pressed onto the insulating foil.

10. The temperature-dependent switch according to claim 1, wherein an upper section of the lower part overlaps the cover part, wherein a circumferential shoulder is provided in the lower part, on which the cover part rests with the insulating foil interposed between the circumferential shoulder and the cover part, wherein the upper section of the lower part presses the cover part onto the circumferential shoulder, and wherein the sealing area is arranged on the circumferential shoulder or on a lower edge of the cover part facing the circumferential shoulder.

11. The temperature-dependent switch according to claim 1, wherein the temperature-dependent switching mechanism carries a movable contact part that interacts with a stationary counter contact that is arranged on a lower side of the cover part facing the lower part and interacts with the first external contact surface.

12. The temperature-dependent switch according to claim 1, wherein the temperature-dependent switching mechanism comprises a bimetal part.

13. The temperature-dependent switch according to claim 1, wherein the temperature-dependent switching mechanism comprises a snap-action spring disc.

14. The temperature-dependent switch according to claim 1, wherein the sealing agent has an annular shape on the insulating foil.

15. A temperature-dependent switch, comprising:

a housing having a cover part and a lower part;

an insulating foil arranged between the cover part and the lower part;

a first external contact surface provided externally on the housing;

a second external contact surface provided externally on the housing; and a temperature-dependent switching mechanism that is arranged in the housing, and that, depending on its temperature, establishes or opens an electrically conductive connection between the first external contact surface and the second external contact surface;

wherein, on a lower side of the insulating foil facing the lower part of the housing, the insulating foil is only partially coated or printed with a sealing agent in a sealing area where the insulating foil is clamped between the lower part of the housing and the cover part of the housing, the sealing agent forms a closed contour on the insulating foil, and wherein a cutting burr is provided on the cover part of the housing, wherein the cutting burr penetrates into the upper side of the insulating foil.

16. A method of manufacturing a temperature-dependent switch, comprising the steps of:

providing a housing having a lower part and a cover part;

providing a temperature-dependent switching mechanism which, as a function of its temperature, establishes or opens an electrically conductive connection between a first external contact surface provided externally on the housing and a second contact surface provided externally on the housing;

providing an insulating foil having a circumferential inner edge and a circumferential outer edge;

before mounting the cover part on the lower part, on at least one of a lower side of the insulating foil or an upper side of the insulating foil, only partially coating or printing the insulating foil with a sealing agent that forms a closed contour on the insulating foil and is spaced from the circumferential inner edge as well as from the circumferential outer edge; and mounting the housing, wherein the temperature-dependent switching mechanism is arranged in the housing and the cover part is mounted on the lower part with the insulating foil interposed between the cover part and the lower part in such a way that the sealing agent for sealing the housing contacts the cover part and/or the lower part in a sealing area where the insulating foil is clamped between the lower part of the housing and the cover part of the housing and in such a way that the circumferential inner edge is arranged inside the housing and the circumferential outer edge is arranged outside the housing.

17. The method according to claim 16, wherein the temperature-dependent switch is heated to activate the sealing agent after mounting the housing.

18. The method according to claim 16, wherein the sealing agent has an annular shape on the insulating foil.

* * * * *